United States Patent [19]

Cazzaro et al.

[11] Patent Number: 4,591,361

[45] Date of Patent: May 27, 1986

[54] METHOD OF PRODUCING ACRYLONITRILE-BASE IN-LINE DYED FIBERS USING RAPIDLY ALTERNATING DYE SOLUTION CROSS FLOW

[75] Inventors: Giorgio Cazzaro, Saronno; Antonino Cavallaro; Gianfranco Casagrande, both of Cesano Maderno; Gianmarco Del Felice, Monza, all of Italy

[73] Assignee: Snia Fibre S.p.A., Cesano Maderno, Italy

[21] Appl. No.: 566,176

[22] Filed: Dec. 27, 1983

[30] Foreign Application Priority Data

Dec. 31, 1982 [IT] Italy ..... 25076 A/82

[51] Int. Cl.[4] ..... D06P 3/60

[52] U.S. Cl. ..... 8/538; 8/151; 8/654; 8/657; 8/927; 8/932; 264/78; 264/180; 264/182

[58] Field of Search ..... 8/538

[56] References Cited

U.S. PATENT DOCUMENTS

| | | | |
|---|---|---|---|
| Re. 25,831 | 8/1965 | Moore | 8/538 |
| 3,111,357 | 11/1963 | Wirth et al. | 8/538 |
| 3,113,827 | 12/1963 | Moore | 8/538 |
| 3,129,577 | 4/1964 | Yamanaka | 68/58 |
| 3,242,243 | 3/1966 | Knudsen | 8/538 |
| 3,483,576 | 12/1969 | Nakagawa et al. | 8/538 |
| 3,533,729 | 10/1970 | Mazzolini et al. | 8/538 |
| 3,787,182 | 1/1974 | Eigenmann et al. | 8/538 |
| 3,907,498 | 9/1975 | Bittle et al. | 8/540 |
| 3,932,571 | 1/1976 | Dworjanyn | 264/206 |
| 3,944,386 | 3/1976 | Wilkinson | 8/538 |
| 3,979,176 | 9/1976 | Kaiser et al. | 8/538 |
| 4,011,294 | 3/1977 | Davis | 264/206 |
| 4,013,406 | 3/1977 | Reinehr et al. | 8/538 |
| 4,445,904 | 5/1984 | Hahnke et al. | 8/538 |

FOREIGN PATENT DOCUMENTS

| | | |
|---|---|---|
| 1056731 | 1/1967 | United Kingdom . |
| 1416851 | 12/1975 | United Kingdom . |
| 1498069 | 1/1978 | United Kingdom . |

OTHER PUBLICATIONS

Chemical Abstracts, vol. 56, 603i.

*Primary Examiner*—A. Lionel Clingman

[57] ABSTRACT

The invention is concerned with a method of producing in-line dyed fibers, in a gel state, characterized in that it essentially consists of extruding the spinning dope in a coagulum bath, stretching the resulting filaments, scrubbing said filaments to remove residual solvent, passing the resulting filament tow through a dyeing bath at an overall rate in excess of 4 $cm^3$ bath per second per square centimeter of tow surface area. The overall rate, being preferably in the 4 to 10 $cm^3$/sec per $cm^2$ range, is achieved by means of crossflows to the forward advance direction of said tow, and alternately directed to and from said tow, the tow residence time in the dyeing bath being no longer than 5 seconds. The tow is then subjected to a dye fixing heat treatment, and is then scrubbed, finished, and dried. The method is particularly suitable for use with substantially acrylic and modacrylic fibers.

4 Claims, No Drawings

METHOD OF PRODUCING ACRYLONITRILE-BASE IN-LINE DYED FIBERS USING RAPIDLY ALTERNATING DYE SOLUTION CROSS FLOW

BACKGROUND OF THE INVENTION

1. Field of the Invention

This invention relates to an improved method of producing acrylonitrile-base in-line dyed fibers, i.e. dyed in the course of the production process. More particularly, the invention concerns a method of producing mainly acrylic or modacrylic fibers which have been wet-spun or dyed in a gel state, that is, a condition occurring during the process step intervening between coagulum and drying.

Such a technology utilizes in particular, as regards gel dyeing, the characteristic of wet-spun acrylic fiber of having a high specific surface area (80–100 $m^2/g$) microporous fibrillar structure, and hence a high capacity and rate of absorption. In such conditions, the presence of acid groups imparts the fiber with the property of quickly fixing the basic dyestuffs employed during the dyeing step.

2. Prior Art

The method of producing in-line dyed fibers has been long known. Also known is to dye acrylic fibers in the gel state, e.g. with the method procedures disclosed in the UK Pat. No. 986,114, in Polish Pat. No. 44274, and U.S. Pat. Nos. 3,111,357; 3,242,243; and 3,113,827, as well as in Japanese Pat. No. 12801/65, U.S. Pat. No. 3,907,498 and French Pat. No. 1.389.015.

However, the application of such methods on an industrial scale would involve considerable difficulties and problems, mainly from the gel dyeing step, which difficulties become the greater as the base tow denier rating increases, i.e. the denier rating of the substantially web-like configuration assumed by the fiber bundle after the coagulum step at the successive deflection and dragging members, and as the count of each individual filament in the tow being treated decreases.

One of the major difficulties is concerned with the micro-uniform dye-taking which the dyed tow should exhibit, i.e. the uniform dyestuff spreading which the fibers are to show within a cross-section area through the tow, which property markedly affects the qualities of the finished articles formed from such fibers.

In order to obtain tows having an adequately micro-uniform dyestuff distribution, especially where high denier tows are being processed—on the order of one million denier above, as demanded by today's markets—the prior art proposes production methods which are hardly satisfactory from the plant layout and economical standpoints, and which not always afford results in keeping with the market requirements. In particular, a first solution for dyeing wet-spun fiber in a gel state, as proposed by the prior art, consists of holding the tow as spread out as possible in the dyeing bath, so as to adequately dye each tow filament. However, this procedure involves the availability of complex equipment, extremely sophisticated to operate, owing to the sensitivity of fibers still in the gel state, to spread the tow and then draw it narrower, as well as a more than negligible risk of damaging the fiber while processing it.

Another prior approach consists of lengthening considerably the two residence time in the bath, either by passing the tow through very long dyeing baths having very high bath volumes, or by using very long dyeing time periods while slowing the tow rate of pass through the dyeing bath.

Both such prior methods pose, accordingly, technological problems, and fail to ensure the highly uniform dye-taking feature which is required of in-line dyed finished fiber.

It has presently been unexpectedly found that by passing, through a tow of mainly acrylic or modacrylic wet-spun fibers still in the gel state, some given dyeing bath flow rates in well defined conditions, it becomes possible to alleviate the problems and difficulties mentioned above, while achieving a dyed fiber with highly micro-uniform dye-taking properties.

SUMMARY OF THE INVENTION

Accordingly, it is a primary object of this invention to provide a method of producing mainly acrylic and modacrylic fibers as dyed in a gel state, particularly useful with high denier tows, which method can provide uniformly dyed fibers having good mechanical characteristics, while using small dyeing bath volumes and short bath residence times.

A further object of this invention is to provide a method of producing dyed fibers, said method being implemented by simple, small bulk equipment designed not to require spreading and subsequent narrowing of the fiber tow in the gel state during the in-line dyeing step.

These and other objects, such as will be apparent hereinafter, are achieved by a method of producing in-line dyed fibers in the gel state, characterized in that it essentially comprises the steps of extruding the spinning dope in a coagulum bath, stretching the resulting filaments, scrubbing said filaments to remove residual solvent, passing through the thusly obtained filament tow a dyeing bath at an overall flow rate in excess of 4 $cm^3$ bath per second per $cm^2$ of tow surface area, said overall flow rate being provided by several crossflows directed transversely to the direction of advance of said tow and being alternately directed to and from said tow, said tow being kept in said bath for a residence time not exceeding 5 seconds, subjecting the dyed tow to a heat treatment for fixing the dyestuff, and then, in a manner known per se, scrubbing, finishing and drying the resulting fiber.

The overall flow rate of the bath through 1 $cm^2$ of tow surface is preferably in the 4 to 10 $cm^3$/second per $cm^2$ range.

Advantageously, the rate of reversal of the direction of said crossflows through said filament tow is in the 10 to 100 cycles per second range.

DETAILED DESCRIPTION OF THE PREFERRED EMBODIMENT

Thus, the invention is characterized by that it provides the conditions and facilities to cause a tow of wet-spun fiber still in the gel state to be swept through by a high dyeing bath flow rate capable of thoroughly dyeing the fiber without causing any of the damage that such a high fluid flow rate may occasion in the sensitive fiber in prior art processing conditions, and consequently without affecting adversely the tow by causing the filaments to break.

The method is specially advantageous with an industrial tow of higher denier (800,000 to 1,200,000 den) having a filament count in the order of 3 den, and accordingly, a high filament density per centimeter of tow width in the 10,000 to 20,000 filament/cm range.

Further advantages will be more clearly understood from the following detailed description of some preferred embodiments of the invention.

As mentioned, the method of this invention is useful in the preparation of fibers with the wet-spinning process and being in-line dyed. It is particularly suitable to the production of acrylonitrile base fibers. In fact, as the polymer, any acrylonitrile base polymers may be used, being essentially acrylic or modacrylic and containing sulphonic or carboxylic acid groups, the polymer being dissolved to form the spinning dope in ordinary organic solvents such as dimethylformamide, di methylacetamide, dimethylsulphoxide, etc., or inorganic ones such as acqueous solutions of sodium sulphocyanide, zinc chloride, etc., such as are usually employed in wet spinning.

The thusly prepared spinning dope is extruded in an acqueous coagulum bath containing a solvent selected from those just mentioned.

Stretching may be effected in a substantially conventional manner.

Dyeing may be effected at a temperature in the 20° C. to boiling range, using generally lower temperatures for light dyes and higher temperatures for deep dyes.

The method enables a wide range of water-soluble cationic dyestuffs to be used, such as derivatives of triphenylmethane, azo- and methinic dyestuffs, etc.

The dyestuffs may be supplied into the dyeing bath either by using pure dyestuffs or diluted ones. In order to prevent dilution of the dyeing bath, it would be preferable to adjust wringing at the dyeing apparatus inlet and outlet such that the amount of water carried along by the dyed tow is larger than that contained by the tow entering the dyeing tank; the impregnation pick-up value would depend, inter alia, on the dyestuff concentration in the feed solution.

Dyeing is effected by passing through the resulting filament tow, having a denier rating which may be quite high and a high density, a flow rate Q of dyeing bath in excess of 4 $cm^3$/sec per $cm^2$, and preferably within 4 to 10 $cm^3$ bath per second per $cm^2$ of tow surface area. This overall flow rate per unit surface area of the tow is achieved by providing several bath streams directed through the tow in transverse directions to the direction of motion of the tow, and arranged to reverse their directions through the tow at a rate "f" in the 10 to 100 cycles per second range. This means that through each $cm^2$ of tow there will pass at each second Q/f $cm^3$ of dyeing bath, f times in both directions.

This dyeing principle may be implemented on any suitable equipment to ensure the above-specified parameters.

According to a preferred embodiment of the invention, the crossflows to the fiber tow are provided by means of an alternate circulation system induced in the dyeing bath. This circulation system may be established, for instance, by a machine comprising essentially a cylindrical drum mounted for idle rotation and being immersed in the bath, which carries on its interior a perforated cylindrical rotor adapted to be rotated at a controlled rpm to suit individual conditions. The tow is run over the idle cylinder which is entrained to move by the motion of the tow itself. The rotor is divided into sectors alternately connected to circulation pumps. One circulation pump functions to pump bath through the rotor center manifold, through alternated operational holes in the rotor, and whence through the tow, thus creating the crossflows from the tow bottom side to the upper side, while another circulation pump, connected to the other rotor sectors via a second manifold arranged concentrically with the former, draws liquid from the bath and forces the drawn liquid to follow a reverse path, i.e. from the bath to the rotor interior through the tow, thus creating the crossflows in the opposite direction to the former. The rate of alternation of such crossflow directions is controlled by adjusting the rotor rpm and/or by changing the number of sectors provided in the rotor.

According to another, more preferred embodiment of the invention, the crossflows to the tow are provided by inducing a vibratory or micro-pulsating motion in the dyeing bath exclusively in the neighborhood of the moving tow. The bath is in this case substantially stationary, excepting in the neighborhood of the tow, where the bath would be vibrated through the moving tow. The bath vibratory motion through the tow may be conveniently achieved by employing a machine such as the one described in U.S. Pat. No. 3,129,577.

The methods described hereinabove ensure a thorough mixing of the bath over the tow surface. It would also be possible to force through a tow, even a highly dense one, high bath overall flow rates per unit surface area of the tow without any risk of damaging the fibers in the gel state, since the stress induced by the bath flow in the tow would be applied to the tow in quick succession with opposed directions.

With the dyeing method of this invention, the tow residence time in the bath is greatly shortened.

In fact, said residence time will not exceed 5 seconds, and preferably lay in the 1 to 3 seconds range.

During the impregnation step, the fibers in the gel state should have a preference a degree of freedom of movement to provide an even better contact of the bath with each individual filament. The tow, therefore, will be preferably slightly relaxed, enough to avoid entangling of the individual filaments. This may be achieved by controlling the tow rate of input and output through the dyeing machine such that the input rate of advance is higher by 0.2% to 2% than the output rate.

On completion of the gel dyeing step, fixing of the dyestuffs to the acid groups of the polymer is carried out by any suitable heat treatment, such as treatment with saturated stem for a duration time in the 3 to 15 seconds range. In actual practice, the residence time of the dyed tow in the fixing phase will be proportional to a desired richness of the color. The fixing step is effected under tension without allowing the fiber to reenter in order to ensure a good lustre for the finished fiber.

Removal of non-fixed dyestuff traces and other additives, if any, which could deteriorate the fiber strength or create other problems such as foul smell of the finished fiber, is accomplished by scrubbing with water at a temperature in the 30° C. to 90° C. range.

For finishing, ordinary lubricating, softening and anti-static products are used, if compatible with the cationic dyestuffs employed, which can preserve the fiber during the drying step and provide for proper processing suitability thereof during the conversion stage. In view of the dyed fiber undergoing no further finishing, such products should also impart the final article with adequately good hand and feel properties.

The following examples illustrate the method according to the invention but are not meant to limit the invention scope thereto.

While this invention has been described with specific reference to a method of producing acrylonitrile base fibers, it would also be generally applicable to any fiber types to be obtained by a spinning technology of the kind of "wet spinning".

EXAMPLE 1

An acrylic dope comprising 21% polymer with the following composition: acrylonitrile (AN) 91.3%, methylacrylate (MA) 8%, and sodium allylsulphonate (SAS) 0.7% in dimethylformamide (DMF), is extruded through a die having capillaries with a 65μ diameter in a coagulum bath containing 50% DMF and 50% water. The resulting filaments are collected at a rate of 10 m/min, stretched to a draft ratio of 5.5, and scrubbed with water at 50° C.

The resulting tow, which contains 13,000 filaments per centimeter of tow width, is substantially web-like and subjected to dyeing in the gel state in a dyeing bath containing 16 g/l of a dyestuff mixture which comprises 13% C.I. Basic Yellow 28, 27% C.I. Basic Red 29, and 60% C.I. Basic Blue 122, in liquid form.

The feed solution is prepared separately which comprises the same dyestuffs, with the same ratii, as in the dyeing bath. The solution thus obtained is fed into the dye tank so as to have 3% of the dyestuff on the fiber.

The tow is fed to the dye tank inlet end at a rate of 55 m/min and a moisture content of 110% over the dry fiber. The tow output rate from the dyeing machine is 54.5 m/min, and the tow entrains a water content of 140% over the dry fiber. The tow residence time in the dye tank is 1.5 seconds.

Dyeing is carried out on a machine like that described in U.S. Pat. No. 3,129,577, so adjusted as to provide a bath overall flow rate through the tow of 6 $cm^3$sec per $cm^2$, and a rate of alternation of the crossflows to the tow of 80 cycles/sec.

The tow as dyed is then subjected to heat treatment under tension using saturated stem for a time period of 10 seconds.

Thereafter, the fiber is scrubbed with water at 50° C. and finished with conventional lubricants, softeners, and anti-statics, as compatible with the dyestuffs being used. Drying is effected at 140° C. in a free shrinkage condition. The fiber has a 25% shrinkage.

The resulting fiber has the following characteristics:
count: 3.3 dtex
toughness: 31 CN/tex
loop toughness: 12 CN/tex
ultimate elongation: 35%
dyeing micro-uniformity: Very good (visually accessed.)

EXAMPLES 2–6

The same procedure as in Example 1 is followed, except that some parameters are changed as shown in the example summarizing table.

The table also shows the characteristics of the resulting products.

TABLE

| | PARAMETERS OF THE METHOD* | | | CHARACTERISTICS OF THE FINAL DYED PRODUCT | | | | |
|---|---|---|---|---|---|---|---|---|
| EXAMPLE | tow density filaments/cm | overall flow rate $cm^5/sec \cdot cm^2$ | rate cycles/sec | dye-taking micro-uniformity | count dtex | toughness CN/tex | loop CN/tex | ultimate elongation % |
| 1 | 13,000 | 6 | 80 | very good | 3.3 | 31 | 12 | 35 |
| 2 | 21,000** | 6 | 80 | very good | 1.7 | 33 | 14 | 32 |
| 3 | 13,000 | 9 | 60 | very good | 3.3 | 30 | 13 | 34 |
| 4 | 13,000 | 6 | 40 | good | 3.2 | 32 | 14 | 38 |
| 5 | 13,000 | 4 | 80 | very good | 3.4 | 34 | 15 | 29 |
| 6 | 21,000** | 4 | 80 | good | 1.7 | 35 | 15 | 33 |

*The unspecified parameters are those described in Example 1. The dyeing machine is the one described in U.S. Pat. No. 3,129,577
**Achieved by extruding the dope through a die having capillaries with a 50μ diameter.

We claim:

1. In a wet spinning process of producing polyacrylonitrile-based fibers wherein a tow is dyed in a hydrated, gel-like condition, passing the fiber tow through a dyeing bath wherein alternating direction crossflows are directed through the tow transversely to the direction of travel of the fiber tow, the improvement comprising said passing is at an overall flow rate of up to 10 $cm^3$ per second per $cm^2$.

2. Process of claim 1 wherein said fiber tow is passed through said dying bath at an overall flow rate of said crossflows of above 4 $cm^3$ bath per second per $cm^2$ of tow surface area, and the residence time of said tow in said dyeing bath is not above 5 seconds.

3. Process of claim 2 said residence time is 1 to 3 seconds.

4. Process of claim 1 wherein said crossflows alternate directions at the rate of 10 to 100 cycles per second.

* * * * *